United States Patent [19]

Salmi

[11] 4,129,032

[45] Dec. 12, 1978

[54] RIBBON DECORATION AND METHOD OF MAKING THE SAME

[76] Inventor: Albert E. Salmi, 9380 Burt Rd., Detroit, Mich. 48228

[21] Appl. No.: 822,906

[22] Filed: Aug. 8, 1977

Related U.S. Application Data

[62] Division of Ser. No. 724,266, Sep. 17, 1976, abandoned.

[51] Int. Cl.[2] ..... B31B 1/14

[52] U.S. Cl. ..... 93/33 R; 33/76 R; 83/468; 83/695; 83/829

[58] Field of Search ..... 93/33 R; 83/522, 468, 83/695, 829; 33/76 R

[56] References Cited

U.S. PATENT DOCUMENTS

| | | | |
|---|---|---|---|
| Re. 23,835 | 6/1954 | McMahon | 428/192 |
| 237,026 | 1/1881 | Knauff | 428/192 X |
| 2,558,217 | 6/1951 | Hess et al. | 83/522 X |

*Primary Examiner*—Leon Gilden

[57] ABSTRACT

A ribbon decoration which is formed of a length of ribbon having a series of transverse slits spaced apart along at least a portion of its length. The slits are formed alternately in one side edge and the other and each slit extends only part way across the width of the ribbon. The ribbon is formed into loops between the slits by interengaging slits on one side of the strip with slits on the other side. A device is also disclosed for slitting the ribbon.

7 Claims, 12 Drawing Figures

RIBBON DECORATION AND METHOD OF MAKING THE SAME

This is a division of application Ser. No. 724,266, filed Sept. 17, 1976, now abandoned.

SUMMARY OF THE INVENTION

The ribbon of this invention may be formed into a ribbon decoration having a plurality of loops without requiring any ties or clips or fasteners of any kind to retain the looped configuration. The ribbon is slit at selected points along its length alternately in one side edge and the other, and then formed into loops by engaging the slits with one another. The ribbon will retain its looped configuration by the small amount of friction between the interfitting slits.

The device of this invention may be used for forming the slits. The spacing between slits determines the size of the loops and also the distance between the loops. The device is adjustable to vary the distance between the slits and to accommodate ribbons of different widths.

Other objects and features of the invention will become more apparent as this description proceeds, especially when taken in conjunction with the accompanying drawings, wherein.

Referring now more particularly to the drawings and especially to FIGS. 1 to 4, there is shown a length of ribbon 10 formed with a series of slits a1, a2, a3, etc., in one side edge and a series of slits b1, b2, etc., in the other side edge. The slits extend transversely of and preferably at right angles to the longitudinal center line of the length of ribbon. The slits are formed alternately in one side edge and the other in spaced relation along the length of the ribbon or at least along that portion thereof in which it is desired to form loops. Each slit extends half way across the width of the ribbon in the preferred construction. Actually, the length of any a slit and the length of any b slit when added together should equal the width of the ribbon.

Figure 1:
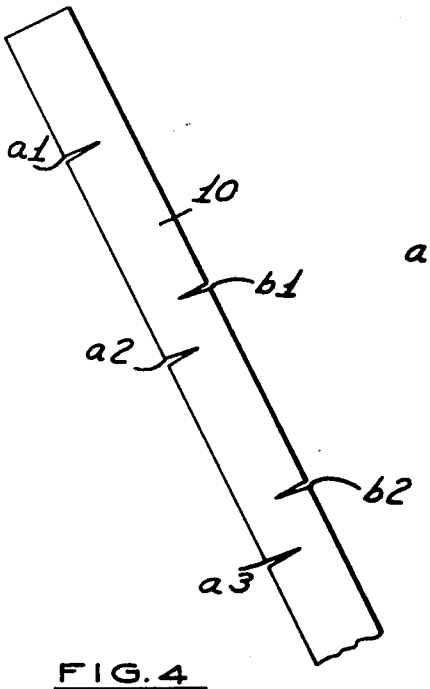
FIG. 1 is a perspective view of a length of ribbon slitted in accordance with my invention.
Figure 2:
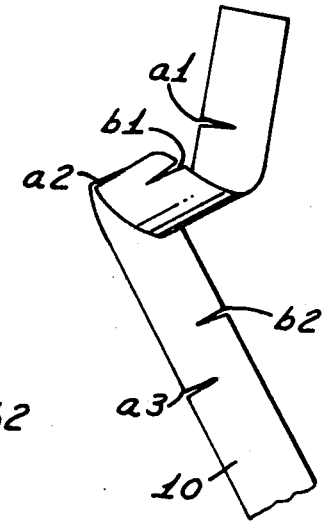
FIG. 2 is similar to FIG. 1 but shows one end portion of the ribbon being started into a loop.
Figure 3:
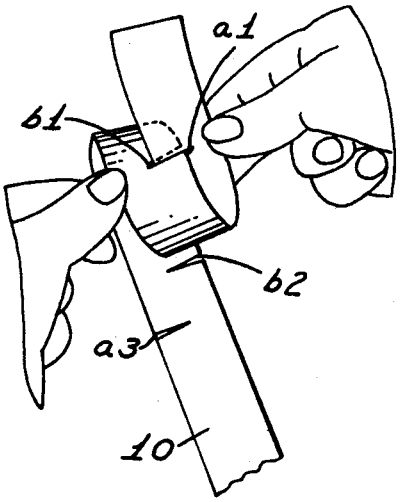
FIG. 3 shows the next step in the procedure in which a loop is actually formed in the length of ribbon.
Figure 4:
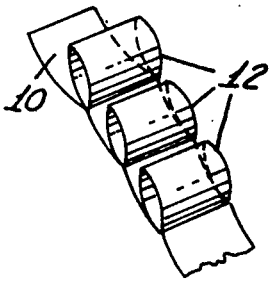
FIG. 4 is a perspective view of a length of ribbon having a series of loops.

Loops are formed in the ribbon in accordance with the steps shown in FIGS. 2 and 3 by interengaging one a slit with the next b slit. Thus, in FIG. 2 the upper end portion of the ribbon is coiled into a partial loop bringing the slits a1 and b1 adjacent to one another and then by a lateral movement interfitting these two slits so that the slit a1 embraces the unslitted portion of the ribbon at slit b1 and slit b1 embraces the unslitted portion of the ribbon at slit a1. In this position, the loop 12 is a full cylinder and all portions of the ribbon forming the loop lie in the same plane (FIG. 4). FIG. 3 shows the loop only partially formed but it will be understood that the fingers in FIG. 3 will be moved toward one another to push the slitted ends of the loop together and close the loop. This looping of the ribbon and interengaging of an a slit with the next b slit, in this instance the slits a1, b1, and the slits a2, b2, is continued to form as many loops as desired depending upon the number of slits formed in a given length of the ribbon.

The slits have a friction hold on the ribbon so that the loops remain intact despite normal handling.

The space between a slit a and the next b slit in sequence determines the size of the loop. Thus the distance between slits a1 and b1 determines the size of the first loop formed from the ribbon of FIGS. 1 to 3, and the distance between slits a2 and b2 determines the size of the next loop. These distances may be the same or may be different depending upon whether loops of the same size or of different sizes are desired. The loops in FIG. 4 are shown as being all formed on the same side of the ribbon but of course some may be formed on one side and some on the other if desired.

The distances between slits b1 and a2 and between slits b2 and a3 etc., determines the spacing between loops. This spacing may be uniform throughout the length of the ribbon decoration or may vary as desired. Such spacing may be the same as, greater than or lesser than the spacing between the slits a1, b1, etc., which determined the size of the loops.

The ribbon may be made of satin, rayon, cloth or any flexible material suitable for the purpose such, for example, as paper, plastic, wood, felt, leather or metal in workable widths and thicknesses and pliable enough to loop.

FIGS. 5 to 12 show a device which may be used for slitting the length of ribbon 10 to be used to form the ribbon decoration of FIG. 4. The device is generally designated 20 and compises a flat board 22 having the flat rectangular layers 24 and 26 secured upon the top surface of the board. These layers 24 and 26 are relatively thin but of sufficient thickness to provide the ridges or walls 28, 30, 32 and 34. The ridges 28 and 32 on layer 24 extend at right angles to one another, and the ridges 30 and 34 of layer 26 also extend at right angles. The layers 24 and 26 are disposed so that ridges 28 and 34 extend in straight line continuation of one another, and the ridges 30 and 32 also extend in straight line continuation. Ridges 30 and 32 face oppositely but may be considered extensions of a single ridge. The same is true of ridges 28 and 34. A scale 35 is laid out on the top surface of the board 22 extending from the ridge 30 and being disposed in spaced parallel relation to the ridge 28.

A rectangular tab or strip 40 of about the same thickness as layers 22 and 24 is adjustably positioned on the top surface of board 22 with one short side 42 resting flush against the ridge 28. This strip 40 has a long side 44 which provides a ridge facing ridge 30 and disposed at right angles to the ridge 28 when placed in adjusted position on the board with its side 42 in surface-to-surface contact with the ridge 28.

A second rectangular tab or strip 50 of about the same thickness as layers 22 and 24 is adjustably positioned on the top surface of layer 24 with its long side 52 forming a ridge parallel to the ridge 28 and its short side 54 flush with the ridge 32. This strip 50 has a scale 55 along its long side 52.

Both strips are formed with holes 60 and have thin flexible covers 62 secured over the tops of the holes by adhesive or the like. These covers may be thin plastic skins and are adhesively coated on the undersides so that when pressed down into contact with the surface of the board or of layer 24 serve to removably, adhesively secure the strips thereto in adjusted position.

Figure 5:
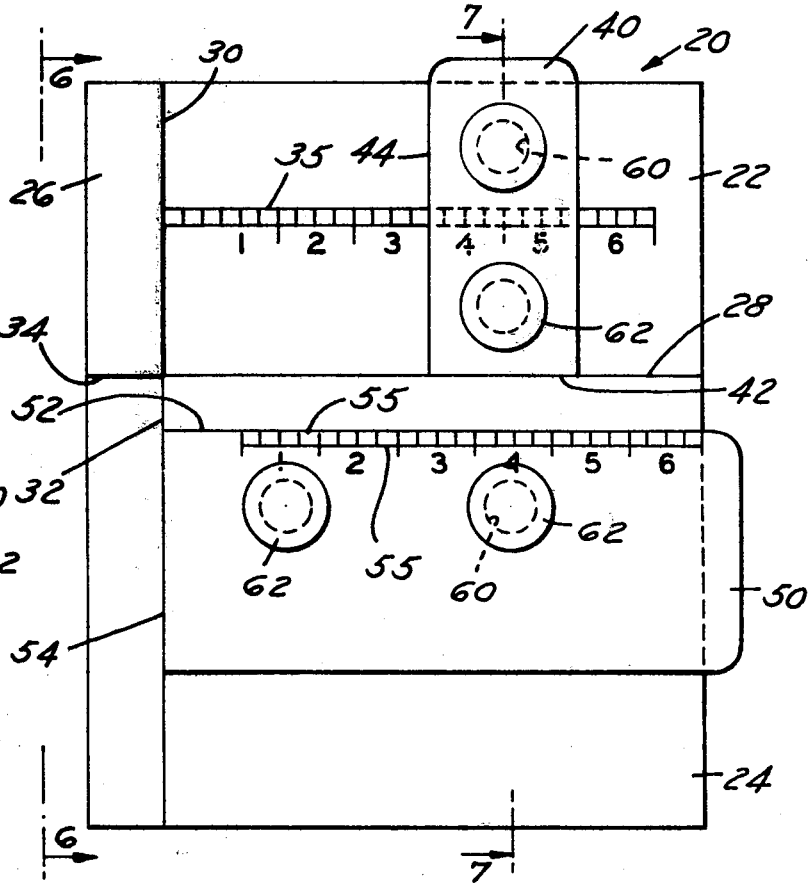
FIG. 5 is a plan view of a device used to slit a length of ribbon to be used in the formation of the ribbon decoration.
Figure 8:
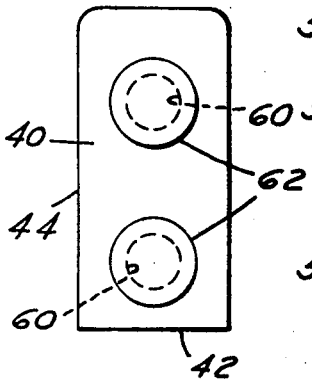
FIG. 8 is a plan view of one of the elements of the device of FIG. 5.
Figure 6:
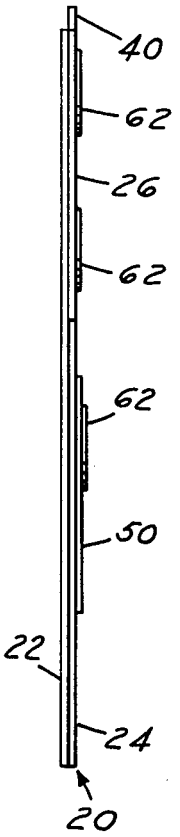
FIG. 6 is an edge view of the device taken on the line 6—6 in FIG. 5.
Figure 7:
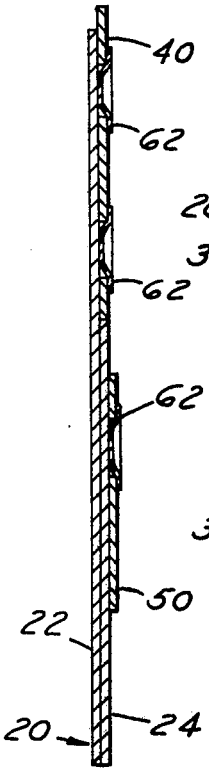
FIG. 7 is a sectional view taken along the line 7—7 in FIG. 5.
Figure 9:
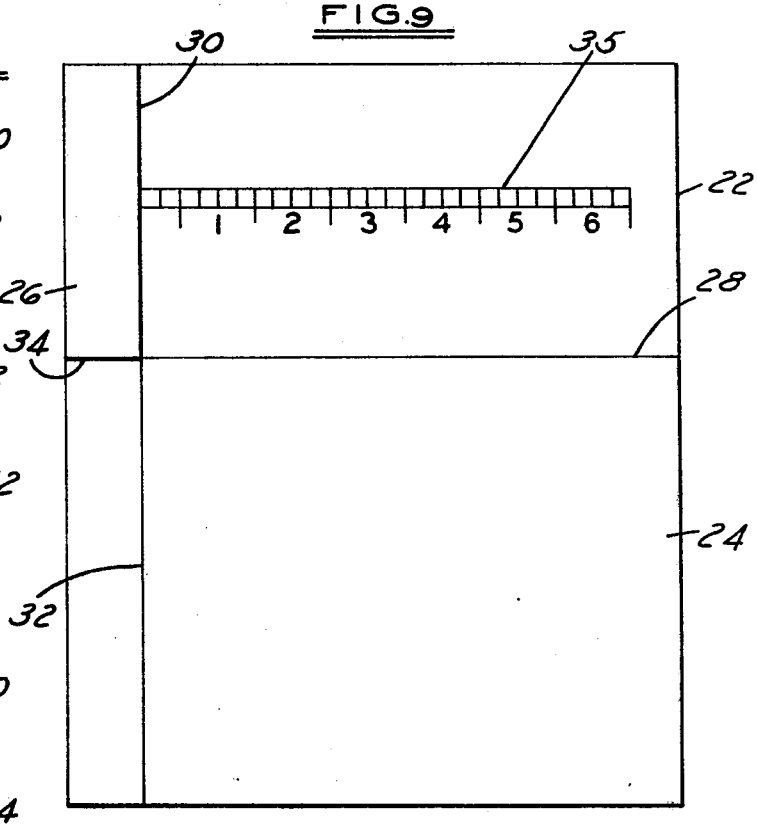
FIG. 9 is a plan view of another of the elements of the device of FIG. 5.
Figure 10:
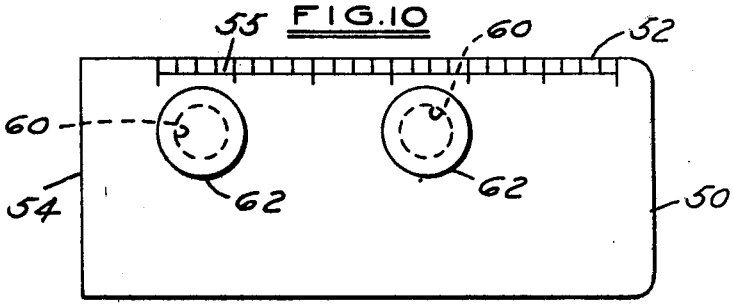
FIG. 10 is a plan view of still another element of the device of FIG. 5.
Figure 11:
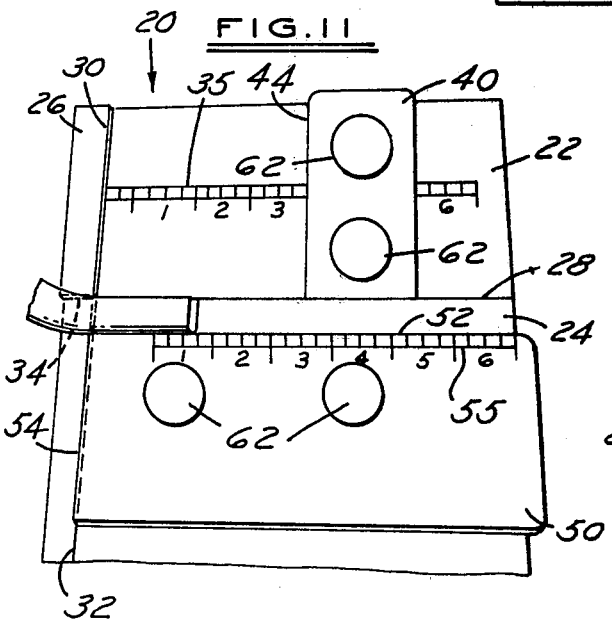
FIGS. 11 and 12 are perspective views showing the device in use.

In use, the strip 40 is placed upon the board 22 with its lower edge 42 in contact with the ridge 28 as shown in FIG. 5 in adjusted position along the length of ridge 28 depending upon the size loop desired. The strip 40 is shown in FIG. 5 with its edge or ridge 44 at the 3½ inch mark on scale 35. A distance of 3½ inches thus exists between the ridges 32 and 44, to cut slits the same distance apart and thereby form loops 3½ inches in circumference.

The strip 50 is secured to the layer 24 in adjusted position with its edge 54 flush with the ridge 32 and its edge or ridge 52 parallel to ridge 28. The strip 50 is positioned so that the distance between its ridge 52 and the ridge 28 is equal to one-half the width of the ribbon to be slit. The locating of the strip 50 in proper position may be accomplished by folding the ribbon in half along its longitudinal center line as in FIG. 11 and laying the folded ribbon with one edge along the ridge 28. The tab for strip 50 is then placed on the layer 24 with its edge 52 extending along the opposite edge of the folded ribbon. The ribbon when unfolded is laid over the board in the position shown in FIG. 12 with one edge thereof in contact with the edge or ridge 52 of strip 50. The longitudinal center line of the ribbon will accordingly coincide with the ridge 28.

Figure 12:
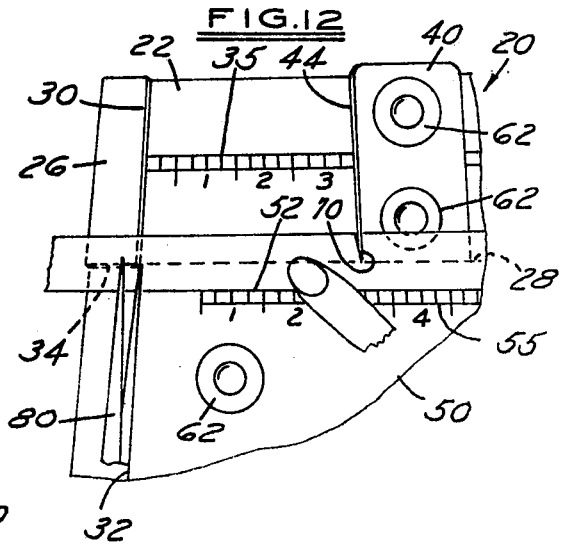

The ribbon may now be slit by placing the side edge of a pair of scissors against the ridge 44 with the point or tip of the scissors in contact with the ridge 28 and transversely severing the ribbon to form a slit as indicated at 70 in FIG. 12. Then the scissors is reversed so that the side of the scissors is in contact with the ridge 32 and its point or tip in contact with the ridge 34. A second slit is formed in the opposite edge of the ribbon at the point indicated by the scissors 80 in FIG. 12. The slits formed will be spaced apart the necessary distance to form a loop of the desired circumference and the slits will extend half way across the width of the ribbon at right angles to the longitudinal center line of the ribbon.

The ribbon is thereafter advanced to the right in FIG. 12 to move the second slit past ridge 44 a distance depending upon the desired spacing between loops and for this purpose the scale 55 is used.

What I claim as my invention is:

1. A device for forming predetermined transverse slits in a length of ribbon, comprising means providing a slitting surface, first, second and third straight elongated ridges on said surface, said second and third ridges intersecting and abutting and extending transversely of and in opposite directions away from said first ridge and being spaced from one another along the length of said first ridge, said second and third ridges providing locators for cutters used to transversely slit a length of ribbon on said surface positioned with its longitudinal center line coextensive with said first ridge, said first ridge serving as a cutter abutment to determine the length of cut of the slits.

2. A device as set forth in claim 1, including a scale on said surface parallel to said first ridge.

3. A device as set forth in claim 1, including means providing an adjustable fourth ridge on said surface extending in spaced parallel relation to said first ridge to provide a locator for one longitudinal edge of a length of ribbon.

4. A device as set forth in claim 3, including a scale on said means providing an adjustable fourth ridge extending parallel to said fourth ridge.

5. A device as set forth in claim 1, wherein one of said transverse ridges is adjustably positioned on said surface.

6. A device as set forth in claim 1, including first means mounting a fourth ridge in adjusted position on said surface extending in spaced parallel relation to said first ridge to provide a locator for one longitudinal edge of a length of ribbon, second means mounting one of said transverse ridges in adjusted position on said surface, said first and second ridge mounting means having holes provided with flexible covers adhesively secured to said surface when pressed against said surface with finger pressure.

7. A device as set forth in claim 6, having a scale on said surface parallel to said first ridge and a scale on said first mounting means parallel to said fourth ridge.

* * * * *